United States Patent [19]

Wentz et al.

[11] Patent Number: 4,643,117

[45] Date of Patent: Feb. 17, 1987

[54] SEWING MACHINE FEED SETTING DEVICE

[75] Inventors: Klaus Wentz; Heinrich Bungert, both of Kaiserslautern, Fed. Rep. of Germany

[73] Assignee: Pfaff Industriemaschinen GmbH, Fed. Rep. of Germany

[21] Appl. No.: 797,818

[22] Filed: Nov. 14, 1985

[30] Foreign Application Priority Data

May 9, 1985 [DE] Fed. Rep. of Germany ... 8513725[U]

[51] Int. Cl.[4] ..... D05B 3/04

[52] U.S. Cl. ..... 112/315; 112/260; 112/318

[58] Field of Search ..... 112/314, 315, 323, 318, 112/311, 260

[56] References Cited

U.S. PATENT DOCUMENTS

| | | | |
|---|---|---|---|
| 2,491,449 | 12/1949 | Hirsch | 112/315 |
| 3,176,642 | 4/1965 | Love | 112/232 |
| 3,596,619 | 8/1971 | Winberg | 112/232 X |
| 4,095,540 | 6/1978 | Kaltenbach et al. | 112/315 |
| 4,204,493 | 5/1980 | Blackwood et al. | 112/260 |
| 4,512,273 | 4/1985 | Skogward | 112/315 |

*Primary Examiner*—Werner H. Schroeder
*Assistant Examiner*—Andrew M. Falik
*Attorney, Agent, or Firm*—McGlew and Tuttle

[57] ABSTRACT

A sewing machine includes a housing with a base portion having a covering base plate and an upright standard adjacent one end of the base portion extending above the base plate and an arm portion extending out of the standard and overlying the base plate. A feed drive in the housing includes a ratchet wheel driven by the feed drive located on the arm portion which cooperates with a shuttle carried in the base portion. The feed drive includes a variable drive including an eccentric which may be shifted so as to vary the driving speed of the shuttle. The construction includes a setting device for setting the speed of the shuttle, an actuating device connected to the setting device and the variable drive so that the drive of the shuttle may be varied. The base plate has an opening adjacent the standard with a holding plate pivotally mounted in the opening on an end of a two armed lever which is pivotally mounted in the base and which is effective to permit shifting of the pin actuator to vary the setting of an eccentric drive.

4 Claims, 2 Drawing Figures

SEWING MACHINE FEED SETTING DEVICE

FIELD AND BACKGROUND OF THE INVENTION

This invention relates in general to sewing machines and in particular to a new and useful setting arrangement for varying a feed drive of the machine which includes an opening in a base portion adjacent the standard which has a pivotal plate connected to a lever which controls the action of a setting device in respect to the shuttle feed drive.

A sewing machine similar to the present invention is disclosed in German Pat. No. 500,869. In this sewing machine, a setting device serving to set the stitch length is arranged on the arm shaft. It was thereby possible to arrange the actuating means required for adjusting the setting device, and which is formed as a spring-loaded pin, in the front wall of the standard facing the operator, thereby making it is easy to operate by the operator. But this advantage is offset by the essential disadvantages that due to the arrangement of the setting device on the arm shaft the overall center of gravity of the sewing machine lies relatively high and that the revolving imbalance produced by the setting device when the sewing machine is running causes especially strong vibrations. Therefore, a sewing machine thus equipped is not suitable for high speeds.

In another known sewing machine, the setting device for adjusting the stitch length was, for that reason, arranged on the feed means drive shaft located in the base plate, namely below the region of the standard. Since then the pivot axis of the setting device lies underneath the table top carrying the sewing machine, also the spring-loaded pin was arranged so that it lies below the table top. As a result, however, it is not in the field of vision of the operator and is therefore comparatively complicated to operate.

SUMMARY OF THE INVENTION

The invention provides a sewing machine with a setting device arranged inside the base plate or below the standard and it is easy to adjust.

By the measure of providing an opening in the base plate and arranging below this opening a lever whose one end is associated with the actuating means and is directly connected with it and whose other end carries a pivotable holding plate located inside the opening and closing it, even an actuating means in a difficult to access location is movable into the active position in a simple manner. The operator first pivots the holding plate into a vertical position by a downwardly directed force and thereafter pivots the lever by a horizontally directed force exerted on the holding plate.

The holding plate, held in a horizontal position by a spring and a stop, fulfills several functions. In the inactive position it serves both to close the opening in the base plate and as a barrier against unintended rotation of the lever or engagement of the actuating means. After rotation into the vertical position, it then serves as large area handle for turning the lever.

If the sewing machine has lower and upper feed tools, to which a common setting device for the adjustment of the stitch length is associated, this setting device is appropriately arranged below the standard in the region of the base plate. In this case, in which the setting device is especially difficult to access, it is nevertheless less possible through the use of the lever to achieve very simple actuation of the actuating means by placing the opening in the base plate which gives access to the lever in front of the standard.

Accordingly it is an object of the invention to provide a sewing machine having an improved setting means for the feed means drive.

A further object of the invention is to provide a sewing machine which includes a base having an opening adjacent an upright standard containing a setting device for varying the feed means drive and which is covered by a pivotal plate mounted on an actuating lever for the drive.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
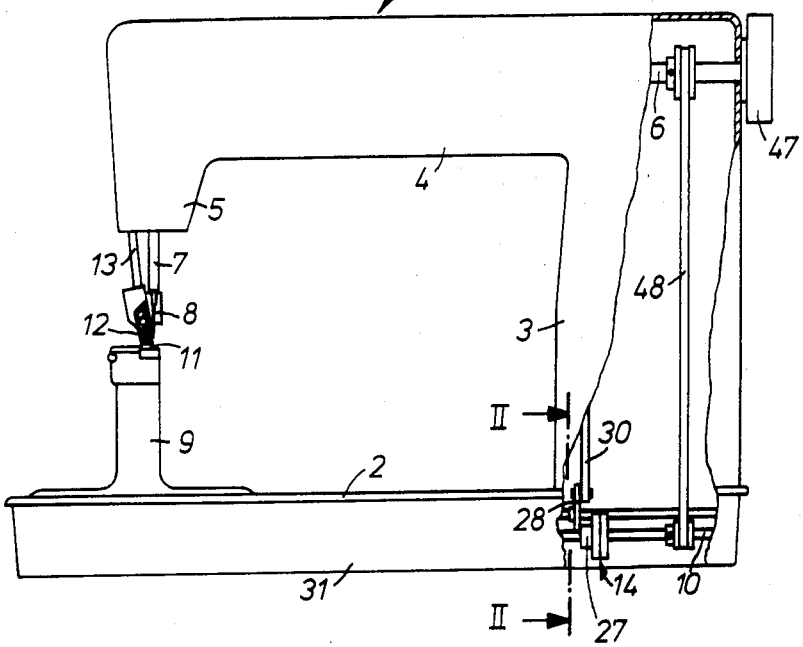
FIG. 1 is a side elevational view partly in section of the sewing machine.

Referring to the drawings in particular the invention embodied therein comprises an improvement in a sewing machine which has a housing 1 including a base portion 31 with a covering base plate 2, an upright standard 3 adjacent an end of the base plate and an arm portion 4 extending out of the upright standard 3 and overlying the base plate 2. The arm portion terminates in head 5.

A feed drive in the housing including a ratchet wheel 11 and a driven roller 12 which is driven by a feed means drive shaft 13 located in the arm portion 4. The feed drive is operated by a variable eccentric drive 26 which may be adjusted by an adjusting ring 20 under the control of a pin actuator 37 controlled by a two armed lever 34. In accordance with the invention, the base plate has an opening 41 which is closed in an inoperative position by a holding plate 43 which is pivotally mounted on a bolt or axle 42 of the two-armed lever 34. In an non-actuating position the plate is horizontal and closes the opening 41.

In head 5, a needle bar 7 is arranged which is driven through an arm shaft 6 and a crank gear (not shown). The bar 7 is movable up and down, and carries a threaded needle 8. The needle 8 cooperates with a rotary hook (not shown) which is arranged in a column 9 and which is connected with a rotary hook drive shaft 10 mounted in the base plate 2.

The feed tools of the feed means comprises the ratchet wheel 11 mounted in column 9 and the driven roller 12. The roller 12 is carried by a presser bar (not shown) disposed behind the needle bar 7, and is in drive connection with a shaft 13. The ratchet wheel 11 is designed in known manner as a ring.

On the rotary hook drive shaft 10, below standard 3, a setting device 14 for the ratchet wheel 11 and roller 12 is arranged. In construction and operation the setting device 14 corresponds to the setting device disclosed in German Pat. No. 500,869. Accordingly it contains a guide disc 15 secured on the rotary hook shuttle drive shaft 10, for a cross-shaped eccentric-support 16. The eccentric support 16 is received by guide ribs 17, 18 in grooves, (not shown) of the guide disc 15 for displacement crosswise to the longitudinal axis of the rotary hook drive shaft 10 and is connected with the guide disc 15 by two screws 19.

On the guide disc 15, the rotatable, axially secured adjusting ring 20 is arranged as adjusting means, which has two recesses 21 on the circumference and an eccentric ring 22. Against the inside of the ring 22 the eccentric support 16 is braced by two arms 23, 24. A spring loaded bolt 25 in arm 24 makes it impossible for the eccentric support 16 to rotate by itself relative to the adjusting ring 20.

The eccentric support 16 has a drive eccentric 26 which is spanned by an eccentric bar 27. The eccentric bar 27 is articulated to one arm of a two-arm crank 28 which is secured on a rocking shaft 29. The rocking shaft 29 is connected, through known gear means (not shown) or other known mechanical connection, with the ratchet wheel 11 and imparts to its stepwise drive movements. At the other arm 28a of crank 28 a connecting rod 30 is articulated, which through known gear means (not shown) or other known mechanical connection is connected with the roller 12 and also imparts stepwise drive movements to it. The size of the synchronously occurring feed steps of the ratchet wheel 11 and of the roller 12 is determined by the magnitude of the eccentricity of the drive eccentric 26 relative to the axis of the rotary hook drive shaft 10.

The two-armed lever 34 is arranged on a support 32 attached to the front wall 31 of the base plate 2, on a bolt or axle 33. An adjustable screw 35 is arranged at the lower end of lever 34. In a bushing 36 fastened at the support 32, the pin 37 is displaceably received, which serves as actuating means for the setting device 14. Placed on pin 37 is a compression spring 38, which is supported at one end on the bushing 36 and at the other end on a washer 39 which is held by a lock plate 40. The position of bushing 36 and the length of lever 34 are matched in such a way that pin 37 always abuts against screw 35. The other end of pin 37 is formed so that it can be introduced into the recesses 21 of the adjusting ring 20.

The upper end of lever 34 protrudes into the opening 41 in the base plate 2 before the standard 3. At the upper end of lever 34, on the horizontally extending bolt 42, the holding plate 43 is pivotably arranged. A thigh spring 44 holds the holding plate 43 in abutment on a stop 45 formed at the lever 34, the holding plate 43 extending horizontally in the upper region of the opening 41, thereby closing it. With the aid of a setting screw 46 arranged at lever 34, the position of lever 34, which is under constant pressure applied by the compression spring 38, can be adjusted so that the holding plate 43 is centered inside the opening 41.

Figure 2:
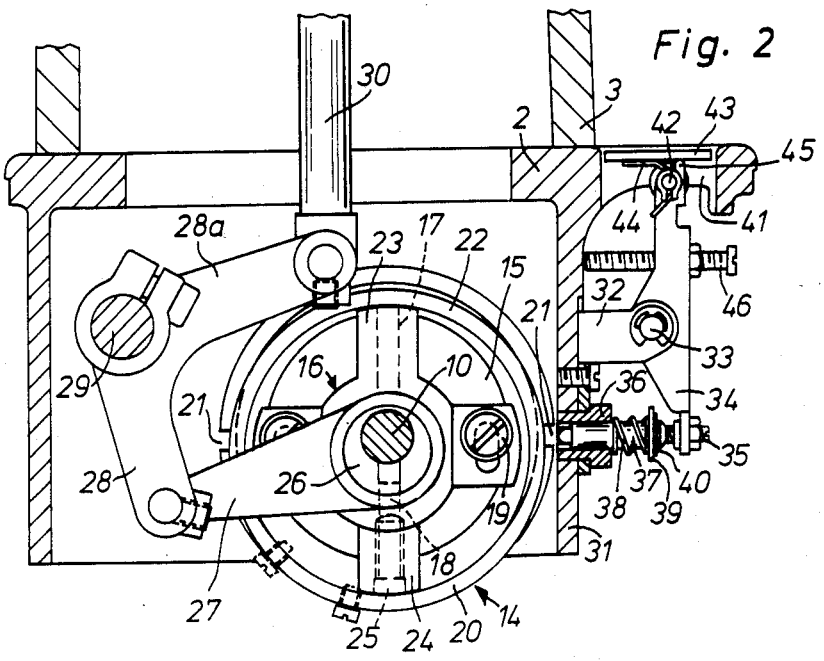
FIG. 2 is an enlarged sectional representation along line II-II of FIG. 1

To adjust the size of the feed steps of the ratchet wheel 11 and of the roller 12, the operator turns the holding plate 43 around the bolt 42 with the sewing machine stopped, and subsequently exerts a horizontally directed force on the holding plate 43. Thereby the lever 34 together with the holding plate 43 is turned clockwise according to FIG. 2 counter to the force of the compression spring 38 around bolt 33, and the pin 37 is pressed against the peripheral side of the adjusting ring 20.

Thereafter the operator rotates a handwheel 47 fastened on the arm shaft 6, the rotary motion being transmitted to the shuttle drive shaft 10 via the arm shaft 6 and a toothed belt drive 48. The handwheel 47 is rotated until pin 37 engages in one of the two recesses 21. It then prevents the adjusting ring 20 from being entrained in rotation further.

By continued rotation of the handwheel 47, with the simultaneous overcoming of the holding force of bolt 25, the eccentric support 16 is rotated relative to the retained adjusting ring 20, thereby giving a new adjustment to the spacing or, respectively, to the eccentricity of the drive eccentric 26 relative to the axis of the shuttle drive shaft 10.

While a specific embodiment of the invention has been shown and described in detail to illustrate the application of the principles of the invention, it will be understood that the invention may be embodied otherwise without departing from such principles.

What is claimed is:

1. In a sewing machine having a housing including a base portion having a cover base plate, an upright standard adjacent an end of said base plate, and an arm portion extending out of said upright standard and overlying said base plate, a threaded needle mounted in said arm portion and movable upwardly and downwardly, a feed drive in said said housing driven by a drive means including a variable drive for variable drive of the feed means, the improvement comprising setting means for setting the speed of the feed drive and actuating means connected to said setting means and the variable drive means to regulate the speed of the feed drive, the base plate having an opening, a holding plate pivotally mounted on the base portion in the opening and closing the opening in an inactive position, a lever pivotally mounted in said base portion adjacent the opening and positioned to engage said actuating means and an axle mounted on said lever and extending across the opening of the base plate carrying said holding plate.

2. A sewing machine according to claim 1, including a spring biasing said holding plate to a horizontal inactive position, stop means adjacent said holding plate stopping said plate in a horizontal position closing the opening of said base plate.

3. A sewing machine according to claim 2, wherein the opening in said base plate is located below the standard of the sewing machine.

4. A sewing machine according to claim 2, wherein the opening of the base plate lies adjacent the base of said standard.

* * * * *